US006981725B2

(12) United States Patent
Debrody et al.

(10) Patent No.: US 6,981,725 B2
(45) Date of Patent: Jan. 3, 2006

(54) PULL SEAL WITH BI-DIRECTIONAL LOCKING ARRANGEMENT

(75) Inventors: Robert F. Debrody, Wayne, NJ (US); George Lundberg, Pompton Plains, NJ (US); Richard Dreisbach, North Arlington, NJ (US); Louis J. Mattos, West Carteret, NJ (US); John DeMarco, Hamburg, NJ (US)

(73) Assignee: E. J. Brooks Company, Livingston, NJ (US)

( * ) Notice: Subject to any disclaimer, the term of this patent is extended or adjusted under 35 U.S.C. 154(b) by 0 days.

(21) Appl. No.: 10/767,094

(22) Filed: Jan. 29, 2004

(65) Prior Publication Data

US 2005/0167994 A1 Aug. 4, 2005

(51) Int. Cl.
*B65D 27/30* (2006.01)

(52) U.S. Cl. ..... 292/307 R; 292/308; 292/317; 292/318; 292/321; 292/322; 292/DIG. 38; 24/16 PB; 24/16 R

(58) Field of Classification Search ..... 292/307 R, 292/317, 318, 321, 322, 315, 316, 319, 323, 292/325, 329, 330, 308, 311, DIG. 38; 24/16 PB, 24/16 R
See application file for complete search history.

(56) References Cited

U.S. PATENT DOCUMENTS

| | | | | |
|---|---|---|---|---|
| 538,912 | A * | 4/1895 | Foote | 292/318 |
| 1,026,701 | A * | 5/1912 | Reid | 292/318 |
| 3,072,986 | A | 1/1963 | Lefnaer | |
| 3,102,311 | A | 9/1963 | Martin et al. | 24/16 |
| 3,192,584 | A * | 7/1965 | Pape | 24/16 PB |
| 3,588,963 | A * | 6/1971 | Moberg | 24/16 PB |
| 3,739,429 | A * | 6/1973 | Kohke | 24/16 PB |
| 3,816,879 | A * | 6/1974 | Merser et al. | 24/16 PB |
| 3,975,040 | A * | 8/1976 | Van Gompel | 292/318 |
| 4,001,898 | A * | 1/1977 | Caveney | 24/16 PB |
| 4,093,288 | A * | 6/1978 | Suzuki | 292/321 |
| 4,106,802 | A | 8/1978 | Lozio | 292/320 |
| 4,183,567 | A * | 1/1980 | Bone | 292/318 |
| 4,245,374 | A | 1/1981 | Suzuki | 24/16 |
| 4,361,351 | A * | 11/1982 | Spirig | 292/321 |
| 4,377,887 | A * | 3/1983 | Valestin | 24/16 PB |

(Continued)

FOREIGN PATENT DOCUMENTS

WO WO85/00152 1/1985

*Primary Examiner*—Brian E. Glessner
*Assistant Examiner*—Carlos Lugo
(74) *Attorney, Agent, or Firm*—Carella Byrne, Bain; John G. Gilfillan, III; William Squire

(57) ABSTRACT

A bi-directional locking socket for use with a seal device which includes a shackle having a plurality of locking elements on a surface thereof. The socket comprises a locking insert forming a locking arrangement including a body defining a chamber therein. The locking insert further includes opposing top and bottom ends where the top end defines a top opening communicating with the chamber, and the bottom end defines a bottom opening communicating with the chamber. A plurality of mirror image spaced fingers define a passageway extending through the chamber. The plurality of fingers allow passage of the locking elements as a free end of the shackle is pulled through the passageway via either the top or the bottom openings in opposite insertion directions, and lock with a locking element of the shackle when the shackle movement is in an opposite direction to the insertion direction. In the alternative, the socket has a chamber with the locking arrangement formed one piece therewith.

30 Claims, 11 Drawing Sheets

U.S. PATENT DOCUMENTS 4,559,676 A 12/1985 Paradis ..... 24/16
4,588,218 A * 5/1986 Guiler et al. ..... 292/307 R
4,609,218 A * 9/1986 Chevillard et al. ..... 292/320
4,854,014 A 8/1989 Ueno ..... 24/16
5,568,952 A 10/1996 Ruegg ..... 292/318
5,758,390 A * 6/1998 Villeneuve ..... 24/16 PB
5,848,771 A * 12/1998 Hancock-Bogese et al. ..... 248/74.3
5,884,367 A 3/1999 Teagno et al. ..... 24/16
5,911,368 A * 6/1999 Davignon ..... 24/16 PB
5,943,741 A 8/1999 Furutsu ..... 24/16
5,956,813 A * 9/1999 Cooper ..... 24/16 PB
6,047,448 A * 4/2000 Arnold ..... 24/16 PB
6,174,006 B1 * 1/2001 Burt ..... 292/307 A
6,185,792 B1 2/2001 Nelson et al. ..... 24/16
6,658,703 B1 * 12/2003 Teagno et al. ..... 24/16 PB
2003/0066169 A1 * 4/2003 Liu ..... 24/16 PB
2004/0049890 A1 * 3/2004 Kurmis ..... 24/16 PB

* cited by examiner

PULL SEAL WITH BI-DIRECTIONAL LOCKING ARRANGEMENT

This invention relates to locking security seals, and more particularly, to molded plastic locking seals having a locking socket for bi-directionally receiving and lockingly engaging a mating shackle.

CROSS REFERENCE TO RELATED APPLICATIONS

Of interest is commonly owned U.S. Pat. No. 6,449,808.

Lockable seals are used where it is necessary to ensure that there has been no unauthorized entry or access into a secured container such as a mailbag. For example, such containers may include the contents of shipping containers, mail pouches, shipping bags, or also may include, valves, meters, or storage areas. One piece plastic seals are used in a variety of industries. The seals used include locking characteristics which insure that once closed, the seal can no longer be opened without being damaged or altered, thereby permitting any undesirable manipulation, i.e., tampering, to be recognized.

Thermoplastic molded security seals are in wide use. One type of such seal includes an elongated shackle, with or without teeth, extending from a flag, which is a flat sheet material element for receiving indicia such as a bar code, manufacturer identity, or serial numbers. These flags are referred to as tags. A locking socket extends from the flag at a region adjacent to the shackle junction. The socket has a cavity in which locking tangs are located for engaging the shackle to lock the shackle thereto when inserted in one direction, the tangs precluding withdrawal of the shackle in the opposite direction. Some locking sockets have metal inserts with the locking tangs formed therein. Other sockets are molded thermoplastic with the tangs molded one piece with the socket body, flag and shackle.

For example, a seal may be used to seal mailbags as illustrated in U.S. Pat. No. 4,506,415, where the seal flag is shown extending in one direction and the free end of the shackle is extending generally in the opposite direction. To tighten the seal about the mouth of the bag, the shackle is manually grasped with one hand and the flag is grasped with the other hand. When it is desired to open the seal, the flag is grasped and pulled. The shackle has one or more weakening regions formed by grooves so that when the flag is pulled, the seal breaks at a weakened region.

U.S. Pat. No. 6,449,808 illustrates a security seal with a flag grip and is incorporated by reference herein in its entirety. The seal comprises a flag, a locking socket, a toothed shackle and a loop finger grip, all molded one piece integral from thermoplastic material. The shackle is attached to the socket adjacent to the end of the flag by a shank, and the socket body and flag merge at the end of the flag at the shank. The shackle has a linear array of annular teeth of conventional design. The shank has a weakening groove at the junction of the shank to the flag. The shackle is inserted into the socket uni-directionally, as shown in FIG. 6, and passed through the locking cavity.

U.S. Pat. No. 5,337,503 to Goby, discloses a seal member having a channel therethrough. The seal contains a holder with locking members for the irreversible holding of an end of a flexible band of metal when introduced into the channel. The seal includes spring tongues which give away resiliently when the band is placed through the channel from the right to the left as shown in FIG. 5 permitting the band to pass through. When an attempt is made to pull the band back out, catch members or serrations on the band engage the spring tongues in a clawlike or ratchetlike manner. One drawback of this type of sealing device is that the strap is inserted into the seal in only one direction (unidirectional) to operate correctly, thus the sealing device is less versatile and more clumsy to use in the process of securing a container.

Another unidirectional seal is disclosed in U.S. Pat. No. 5,568,952 to Ruegg which includes a housing which receives through an open end a bail or shackle strap having a plurality of spaced locking elements. The housing includes a plurality of locking fingers having inwardly extending portions configured to abut the locking elements of the strap member. A preferred embodiment of this seal includes locking cage assemblies being separately molded to allow the cages to be formed of a material which exhibits a higher melting point than the remaining portion of the seal, including the housing, strap and the body portion. The housing includes an inlet opening and an outlet openings orientated on a common axis, and thereby discloses a unidirectional seal.

U.S. Pat. No. 4,245,374, to Suzuki discloses a connector formed of flexible plastic such that a flexible flange on a male inserting head engages the pivotal lock lugs of a female socket during insertion and cannot be withdrawn following insertion. The female locking head permits the male locking member to be inserted from either direction into the socket opening. The connector comprises a socket aperture in which two opposed pivotal locking lugs are mounted on opposed sides by means of flexible pillars. A disadvantage of the Suzuki, connector is that the narrow flexible pillars can wear and fatigue-with deflection of the lugs to the point of breaking and thus defeat the seal.

U.S. Pat. No. 4,106,802 to Lozio, discloses a self-locking band to be used as a seal or tag holder. An integral elastomeric body forms a flexible stem terminating at one end in a double hook in an arrowhead configuration for interlocking of the arrowhead with the flanks of dovetails in the sleeve of a socket in either direction of insertion. The arrowhead hook of the stem is able to be inserted into the sleeve from either end thereof for interengagement with the corresponding pair of barbs of the dovetail shaped internal projections. A longitudinal slot extends from near the tip of the arrowhead to the vicinity of shoulders which reduces weight and increases the flexibility of the tongue for easier interfitting.

U.S. Pat. No. 6,185,792 to Nelson et, al., discloses a one-piece bidirectional cable tie for bundling articles having a tail at one end, a locking head at the other end and an elongated strap body therebetween. The cable may feature one or more fixed locking teeth opposite a deflectable locking pawl so as to provide ratcheting locking engagement with the two major surfaces of its strap body. The pawl is a symmetrical structure extending from a central hinge integrally formed with the strap body. As with other known devices, the central hinge can be prone to fatigue due to excess pivoting.

U.S. Pat. No. 3,816,879 to Merser et. al., discloses a fastener formed by an elongated member attached to a bidirectional locking head with longitudinally opposed openings. The elongated member is inserted into either of the opposed openings of the head where it is engaged and locked in place by one or more longitudinally extending internal locking vanes. The vanes can change direction and flex about a pivot area and are susceptible to fatigue as with other known sealing devices.

U.S. Pat. No. 4,854,014 to Ueno discloses a fastener comprising a filament, a head provided on one end of the filament, and a socket provided at the other end of the filament. The head has a groove extending in the direction of its axis and a rib formed in the groove. The head also has a skirt around the groove and flaring away from the front end of the head. The socket has an insertion hole in which an annular flange is provided for engagement with the skirt. When the head is inserted into the insertion hole of the socket, a slit is compressed and thereby helps the head to deform to engage with engagement surfaces formed in the socket.

PCT International Publication Number WO 85/00152 discloses a fastener including an apertured housing and an elongated member centrally attached to the housing. The elongated member has a free end or apertured tongue that is inserted into one of the circular openings to become irremovably locked in the housing. The walls of the tip are of reduced thickness in order to promote flexure of the end to fit within the housing and mate with the locking ring.

U.S. Pat. No. 3,102,311 to Martin et. al., discloses a tie strap comprising a tail-end portion, a head-end portion, and a body portion. The surface defining the opening in the head-end portion of the strap is also provided with a substantially tapered, flexible pawl-like tooth, integral with the surface and extending into the openings. A clearance space between the top face and the free end of the flexible tooth being such as to permit passage of the uniformly reduced tail-end portion of the strap therethrough. The saw teeth on both sides of the body portion of the strap, and the rigid teeth and flexible pawl-like member within the head-end opening constitute the means integral with the strap for locking the respective end portions thereof in looped relation.

U.S. Pat. No. 5,956,813 to Cooper discloses a one piece cable tie for forming a plurality of objects such as cables into a bundle. The cable tie includes an elongated flexible strap and a locking head integrally formed to the first end of the strap. The locking head defines a strap accepting channel and a locking pawl is pivotally connected to an inner channel wall of the locking head. The pawl has a generally T-shaped configuration and comprises a pawl head which is pivotally connected to inner channel wall by a thin, flexible hinge. The locking pawl lockably engages at least one tooth on the strap and abuts against the projections to prevent withdrawal of the strap from the locking head when the second end of the strap is inserted into the strap accepting channel in through the first open end or when the second end of the strap is inserted into the strap accepting channel in through the second open end.

U.S. Pat. No. 5,911,368 to Davignon, discloses a one piece cable tie including an elongated flexible strap having a first set of ratchet-shaped teeth formed within the first recessed portion and a second set of ratchet-shaped teeth formed within the second recessed portion. The cable tie further includes a locking head integrally formed to the first end of the strap. The locking head includes a strap accepting channel having a first open end formed in a top surface of the locking head and a second open end formed in the bottom surface of the locking head. A locking pawl is pivotally connected to the inner channel wall of the locking head. The locking pawl and the projection lockable engage the teeth on opposite sides of the strap to prevent withdrawal of the strap from the locking head when the second end of the strap is inserted into the strap accepting channel through the first open end or when the second end of the strap is inserted into the strap accepting channel through the second end.

U.S. Pat. No. 5,884,367 to Teagno et. al., discloses a cable tie strap having an elongated strap body and a locking head providing receipt of the cable tie strap in the head in either direction. The cable tie strap includes a hollow locking head and an elongated strap having toothing on each side of the strap. A locking bar is positioned within the hollow head. The strap body may be inserted into the hollow head in either direction. The locking bar is lockingly engagable with the toothing on either side of the strap upon insertion of the strap into the head in either direction. The locking tooth comprises a root part connected to an elastic hinge which flexibly allows the locking tooth to move back and forth.

A drawback of present locking seals and cable ties as described in the above examples is the bi-directional pawl is susceptible to weakness, fatigue and fractures along the structure which allows the pawl to change direction.

A need is seen for a solution to this problem.

SUMMARY OF THE INVENTION

According to an aspect of the present invention, a bidirectional locking device and locking seal is provided including a socket having a body with a chamber. A locking arrangement is in the chamber which arrangement may include an insert which is inserted into the socket chamber for receiving and locking a flexible shackle thereto. The shackle has at least one locking element having a tapered portion and a transverse locking shoulder such that the shackle is insertable into the chamber for engaging the locking arrangement. The locking arrangement comprises a body defining a chamber therein having a longitudinal axis extending therethrough and defining a longitudinal direction. The body has opposing top and bottom ends where the top end defines a top opening communicating with the chamber in the longitudinal direction, and the bottom end defines a bottom opening communicating with the chamber in the longitudinal direction. A plurality of resilient fingers are positioned in the chamber and extend from the body ends toward each other in the longitudinal direction. The plurality of fingers are positioned to allow passage of the at least one locking element of the shackle in first and second opposite insertion directions through either the top or the bottom opening. At least one of the fingers is for lockingly engaging the at least one locking element shoulder in response to the shackle movement in an opposite direction to the insertion direction to lock the shackle to the insert in the opposite direction.

In a further aspect the locking device includes fingers which terminate at a respective corresponding tip portion which abut with and lock with the at least one locking element in response to the shackle movement in the opposite direction.

In a further aspect the locking device includes at least one first finger which extends from the top end and locks with the shackle with at least one locking element shoulder when the shackle insertion direction is through the top opening and the shackle is being moved in the opposite direction to the shackle insertion direction. The at least one second finger extends from the bottom end and locks with the shackle at least one locking element shoulder when the shackle insertion direction is through the bottom opening and the shackle is being moved in the opposite direction to the shackle insertion direction.

In a further aspect the locking device includes the fingers each being resiliently radially deflected in response to passage of the at least one locking element of the shackle in the chamber. Either the at least one top finger or the at least one bottom finger locks with the at least one locking element of the shackle when the shackle is pulled in a direction opposite the insertion direction.

In a further aspect the locking device includes the plurality of fingers having a pair of transversely opposing spaced top fingers relative to the longitudinal axis and an opposing pair of transversely spaced bottom fingers. The top and bottom pairs of fingers respectively extend toward one another.

In a further aspect the locking device includes the plurality of fingers having at least one top and at least one bottom finger. The at least one top and bottom fingers are in a mirror image relationship.

In a further aspect the locking device includes at least one top and bottom fingers each have a channel that extends at an angle inclined toward the longitudinal axis.

In a further aspect the locking device includes the top and bottom fingers having a first portion having a first channel extending in the longitudinal direction connected to the bottom and top ends and a second distal portion having a second channel extending from the first portion first channel at an angle.

In a further aspect the locking device angle is acute.

In a further aspect the locking device second portion extends toward the longitudinal axis.

In a further aspect the locking device includes the top and bottom fingers extending in a direction transverse to the longitudinal axis.

In a further aspect the locking device includes the second distal portion of the fingers extending in a direction transverse to the longitudinal axis.

In a further aspect the locking device includes the finger tip portions terminating at a chamfered edge.

In a further aspect the locking device includes fingers which are integrally molded one piece with the top and bottom ends.

In a further aspect the locking arrangement includes an insert molded one piece thermoplastic.

In a further aspect the locking device includes the passageway being adapted to receive a locking element which is arcuate.

In a further aspect the locking device includes a passageway for receiving a frusto-conical locking element.

In a further aspect the locking device includes first and second pairs of spaced mirror image fingers, each pair in mirror image orientation to the other pair, the pairs each defining a portion of a common passageway in the longitudinal direction. The passageway receives a frusto-conical shackle locking element which includes a rim with a shoulder which abuts with the fingers of one of the first and second pairs of spaced mirror image fingers when the shackle is moved in the opposite direction to the insertion direction.

In a further aspect the locking device further includes a socket having a chamber, wherein the locking arrangement includes a locking insert fixedly attached inside the socket chamber.

In a further aspect the locking device includes a socket integral and one piece with the shackle and with a flag and extends substantially perpendicular to the shackle longitudinal axis.

In a further aspect locking arrangement includes an insert body that is substantially cylindrical.

In a further aspect the locking device insert body has a plurality of spaced side walls defining the chamber.

In a further aspect the locking device includes a passageway being defined by the at least one first and second fingers and an inner side wall in transverse spaced relation relative to the longitudinal axis. The locking element lockingly abuts the inner side wall when the fingers lock with the locking element shoulder.

In a further aspect the locking device inner side wall includes a recess adapted and positioned for lockingly engaging the locking element when the fingers lock with the locking element shoulder.

In another aspect of the present invention, a bidirectional lockable sealing device comprises a socket defining a first chamber therein, a shackle having at least one locking element, the shackle being fixed at one end to the socket and having a free end opposite the one end. A locking insert is secured to the socket in the first chamber, the locking insert including a body defining a second chamber therein having a longitudinal axis extending therethrough defining a longitudinal direction. The locking insert including opposing top and bottom ends where the top end defines a top opening communicating with the second chamber, and the bottom end defines a bottom opening communicating with the second chamber. A plurality of resilient fingers are positioned in the second chamber at least one first finger of the plurality extending from the top end and at least one, second finger of the plurality extending from the bottom end toward the first finger. The fingers defining a passageway in the second chamber being arranged to allow passage of the at least one locking element as the free end of the shackle is pulled through the passageway in an insertion direction via either the top or the bottom opening. The fingers are in sliding resilient engagement with the at least one locking element, and one of at least one first and second fingers is arranged to abut and lock to at least one of the locking elements of the shackle when the shackle movement is in an opposite direction to the insertion direction providing locking resistance to the shackle.

In a further aspect the sealing device includes at least one finger extending from the top end which locks with the at least one shackle locking element when the shackle insertion direction is through the top opening and the shackle is being moved in the opposite direction to the shackle insertion direction. The at least one finger extending from the bottom end locks with the shackle at least one locking element when the shackle insertion direction is through the bottom opening and the shackle is being moved in the opposite direction to the shackle insertion direction.

In a further aspect the sealing device includes a flag structure attached to the socket.

In a further aspect the sealing device includes a shank positioned between the socket and the shackle.

In another aspect of the present invention, a bidirectional lockable sealing device comprises a socket including a body defining a chamber therein having a longitudinal axis extending therethrough defining a longitudinal direction. The socket includes opposing top and bottom ends where the top end defines a top opening communicating with the chamber, and the bottom end defines a bottom opening communicating with the chamber. A shackle is included having at least one locking element fixed at one end to the socket and having a free end opposite the one end. A plurality of fingers are positioned in the chamber of the socket, where at least one first finger of the plurality extends from the top end, and at least one second finger from the plurality extends from the bottom end toward the first finger. The fingers define a passageway in the chamber arranged to allow passage of the at least one locking element as the free end of the shackle is pulled through the passageway in an insertion direction via either the top or the bottom opening such that the fingers are in sliding engagement with the at least one locking element. One of the first and second fingers is arranged to abut and lock to at least one of the locking elements of the shackle when the shackle movement is in an opposite direction to the insertion direction providing locking resistance to the shackle.

DETAILED DESCRIPTION OF THE PREFERRED EMBODIMENT(S)

Figure 1:
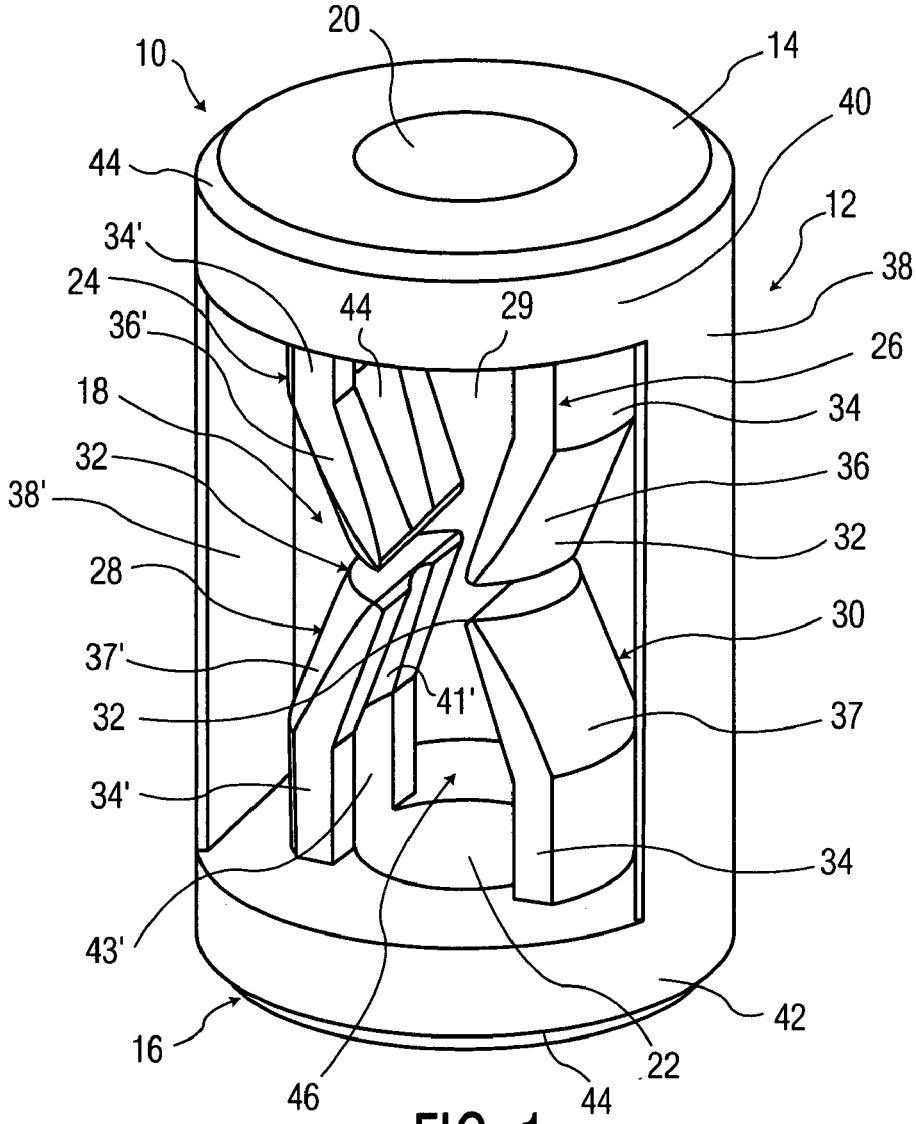
FIG. 1 is an isometric view of a locking insert for use in a socket of a locking seal device.
Figure 2:
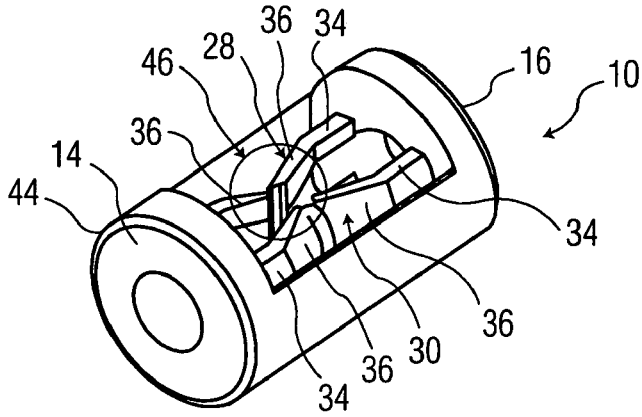
FIG. 2 is a further isometric view of the locking insert shown in FIG. 1.
Figure 5:
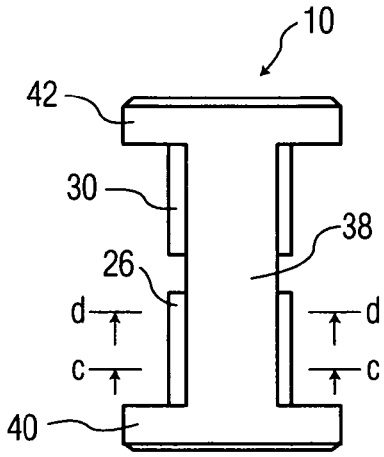
FIG. 5 is a side elevation view of the locking insert of FIG. 4 taken along line f—f.

In FIG. 1, a preferred embodiment of a locking insert 10 is shown. The insert 10 forms a locking arrangement which is used in a locking seal device 100, FIGS. 7–8. The locking insert 10 comprises a cylindrical shaped body 12 having a top end 14 and a bottom end 16. The body 12 defines an internal chamber 18 and two longitudinally extending mirror image side walls 38, 38'. The body further includes upper and lower circumferential rims 40, 42, respectively, at the respective top end 14 and the bottom end 16, and integral with relatively thin, narrow side walls 38, 38' in the shape of strips. The integral one-piece relationship between the rims 40, 42 and the side walls 38, 38' (one being shown) is shown in FIG. 5. All the elements of the locking insert 10 (and the locking seal device 100) are made from, and molded, preferably, thermoplastic material. The insert is preferably one piece. The locking seal device 100 (FIGS. 7 and 8) without the insert 10 is preferably molded one piece.

The rims 40, 42 terminate in a chamfered edge 44 at the top and bottom surfaces at ends 14, 16. The top end 14 defines a substantially central top opening 20 which communicates with the chamber 18. The bottom end 16 also defines a substantially central bottom opening 22 which communicates with the chamber 18.

Preferably, two top flexible fingers 24, 26, respectively, and two bottom flexible mirror image fingers 28, 30 are positioned in the chamber 18. The two top fingers 24, 26 depend from the inner surface of the top rim 40 and extend toward the center of the chamber terminating in a tip portion 32. The top fingers 24, 26 are in mirror image spaced relation to each other on opposite sides of the longitudinal axis 2, shown in FIG. 3, as are the bottom fingers.

The fingers are preferably attached to the rims by being permanently affixed, such as by molding as one piece or bonded and so on. The two bottom fingers 28, 30 are similarly located in spaced relation from each other on opposite sides of the longitudinal axis 2 (FIG. 3), and are in respective mirror image spaced relation from the two top fingers 24, 26 and to each other. Except for their orientation and positions, the fingers 24, 26, 28, and 30 are identical.

Figure 3:
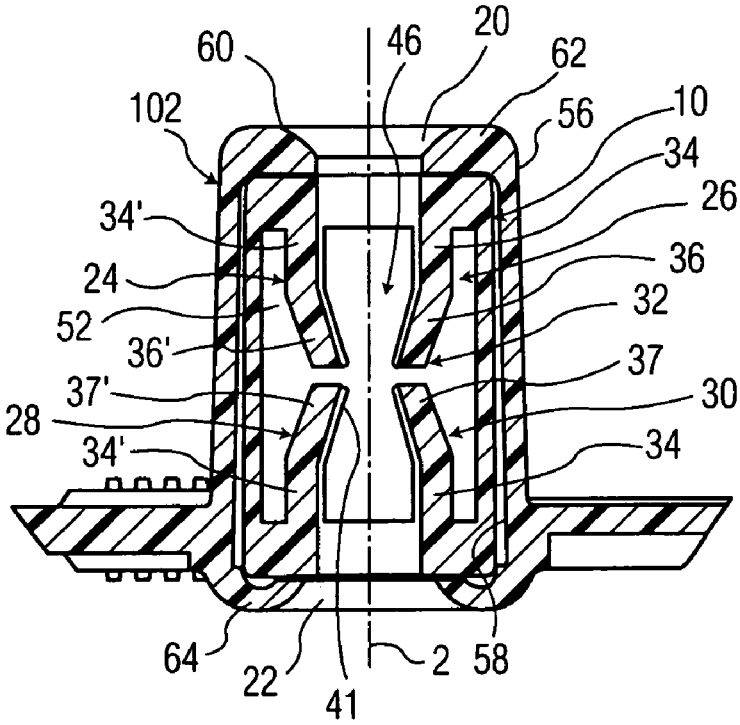
FIG. 3 is a side elevational sectional view of the locking insert shown in FIGS. 1 and 2 in a socket similar to the view of FIG. 6.
Figure 4:
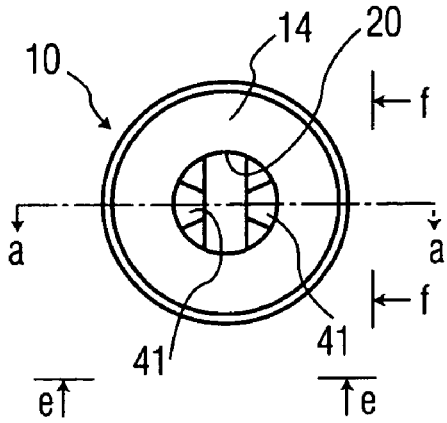
FIG. 4 is a plan view of the locking insert shown in FIG. 1.
Figure 4A:
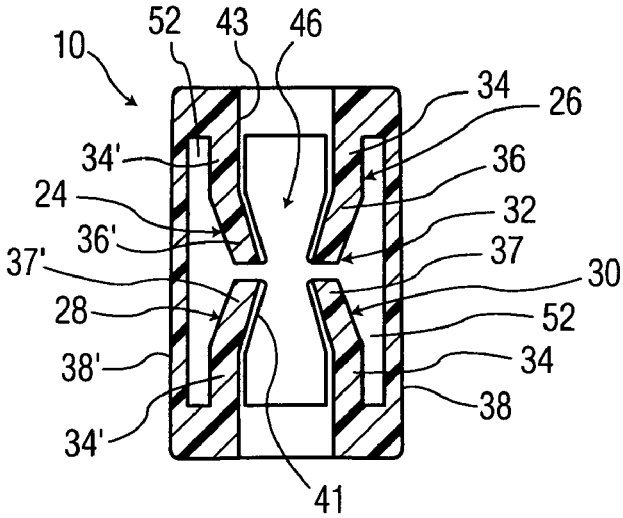
FIG. 4*a* is a side elevational sectional view taken along line a—a in FIG. 4.
Figure 4B:
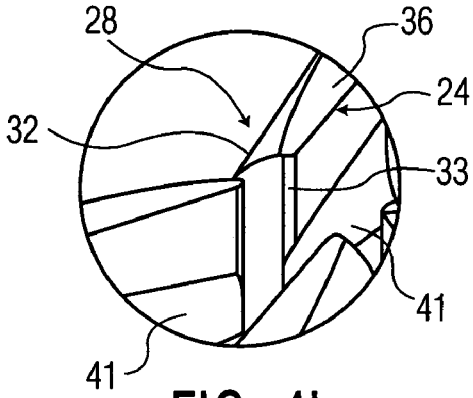
FIG. 4*b* is a detail isometric view taken at region 4*b* of FIG. 2.

The tip portions 32 of the fingers 24, 26, 28, 30 preferably include a chamfered edge 33, as shown in detail in FIG. 4*b*. The chamfered edges 33 facilitate the smooth interaction of the frusto-conical portion 108 (FIG. 8*a*) of the locking elements 106 on the shackle 104 with the tip portions of the fingers. The collection of fingers 24, 26, 28, 30, shown in FIGS. 1, 3, and 4*a*, define a substantially central passageway 46 aligned with the top and bottom openings 20, 22. The passageway 46 receives the shackle 104 of a locking seal device 100 shown in FIGS. 7–8.

The bottom fingers 28, 30 are attached to the inner surface of the bottom rim 42 and terminate at opposite ends at a tip portion 32. The bottom fingers 28,30 extend toward the center of the chamber. The tip portions 32 of the top fingers and the bottom finger tip portions are in facing spaced relation to each other.

Figure 4C:
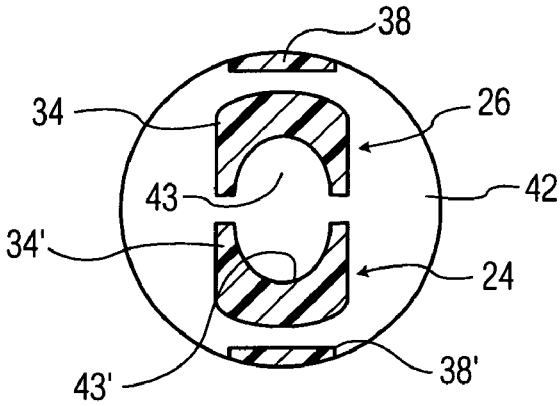
FIG. 4*c* is a sectional plan view of the insert of FIG. 5 taken at lines c—c.
Figure 4D:
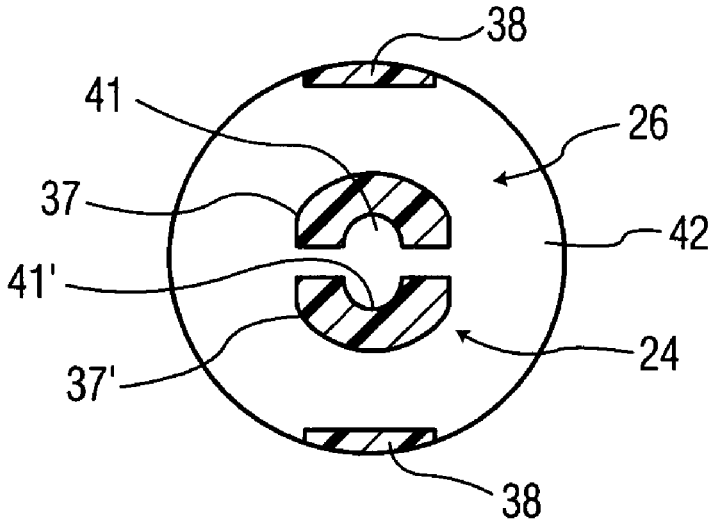
FIG. 4*d* is a sectional plan view of the insert of FIG. 5 taken at lines d—d.
Figure 4E:
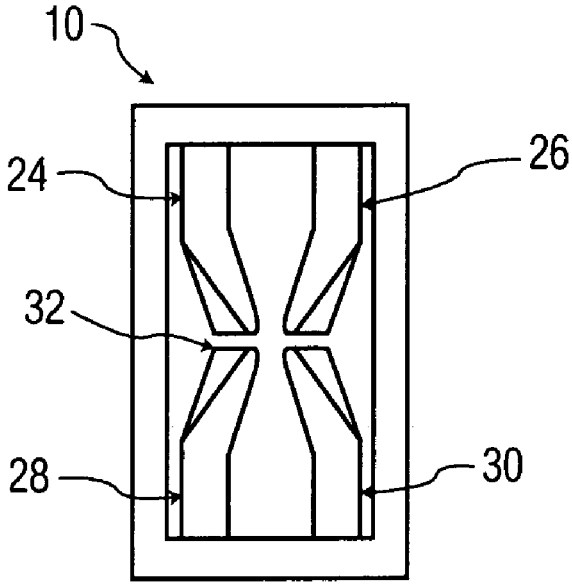
FIG. 4*e* is an elevational side view of the insert of FIG. 4 taken at lines e—e.

Each of the top and bottom fingers 24, 26, 28, 30 preferably have a base portion 34, 34' that is a segment of a circular cylinder with a semi-circular, cylindrical, concave channel 43, shown in FIG. 4*c*. The base portions extend from the inner surface of the respective top and bottom rims 40, 42, respectively. The fingers also include an angled portion 36, 36', 37, 37' extending from the respective base portions. The angled portions incline relative to and toward the axis 2, FIG. 3. The base portions 34, 34' have a semi-circular, cylindrical, concavity in facing mirror relation image. The angled portions 36, 36', 37, 37' have mirror image, tapering concave channels 41 which become narrower toward the tips 32. The concave channels 41 and 43, FIGS. 4*c* and 4*d*, are continuous.

Figure 10:
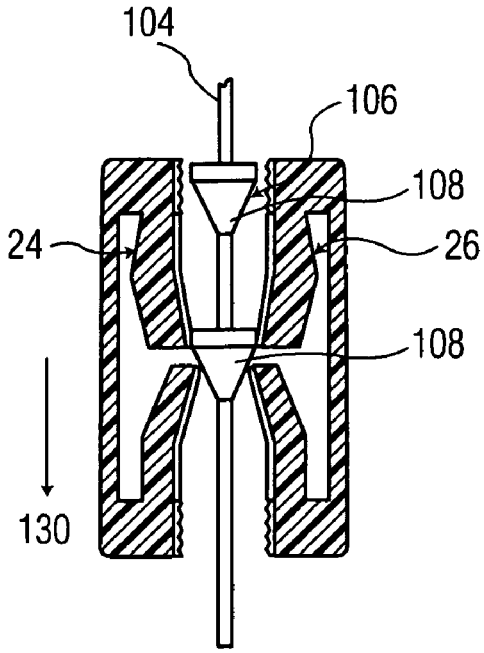
FIG. 10 is a side elevational view in cross section of the locking insert shown in FIG. 9 where the locking elements are further along in the passageway in the insertion direction than shown in FIG. 9.

The locking insert is shown in cross section in FIG. 4*a* which depicts the base portions 34, 34' of the fingers and the angled portions 36, 36', as also shown in cross section in FIG. 3. The arrangement of the fingers forms a space 52 between the fingers and the housing walls 38, 38'. The fingers thereby have space available to flex radially outwardly when riding up the frusto-conical surface 108 of the shackle 104 locking elements 106, as shown in FIG. 10. The angled portions 36, 36', 37, 37' of the fingers extend transverse to the longitudinal axis toward each other defining a smaller passageway between the finger tip portions 32. The tip portions 32 thereby resiliently flex radically outwardly and lockingly engage the shoulders 112 of the locking elements 106 on the shackle when the shackle is pulled in an opposite direction to insertion.

An advantage to the fingers 24, 26, 28, 30 is their flexible nature which permits them to ride over the frusto-conical portions of the locking elements 106 (FIG. 10) while flexing radially outwardly. They resiliently return to their initial position when the greatest diameter of the locking element, at the rim 110 shown in FIG. 11, has moved past the finger tip portions 32. At this point, the opposite finger tip portions 32 are ready to make locking contact with the shoulder 112 (see FIG. 11) of the frusto-conical locking element 106 when the strap is pulled in a direction opposite its insertion.

Figure 6:
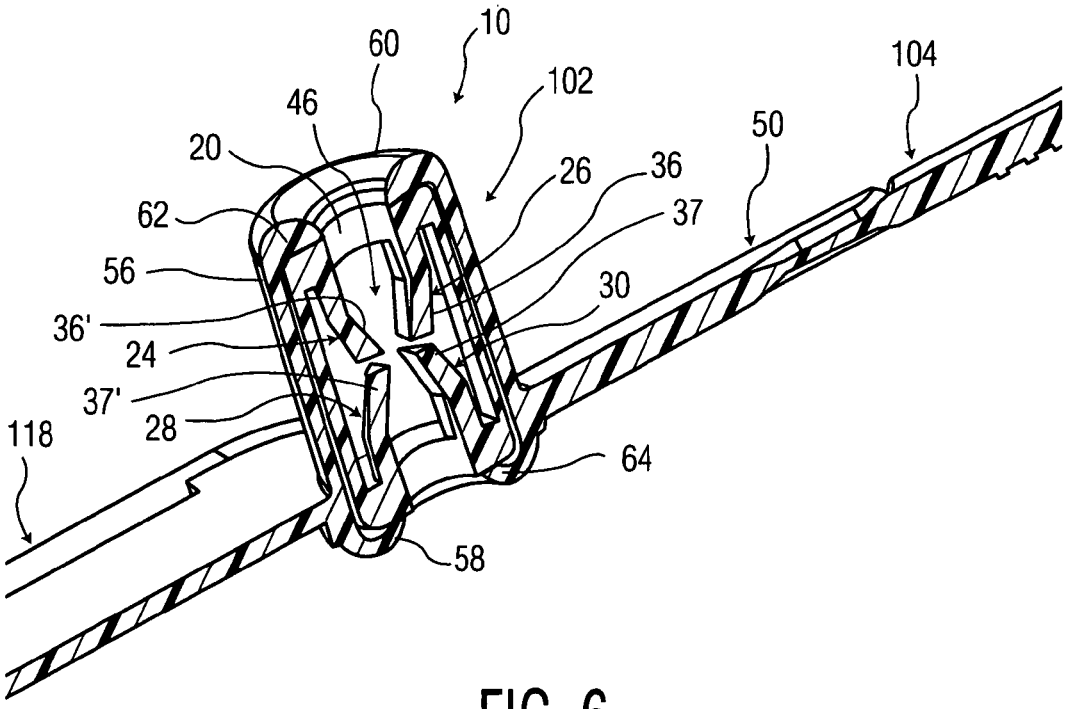
FIG. 6 is an isometric view in cross section of a locking seal device including the locking insert of FIG.: 1.

In FIGS. 3 and 6, locking insert 10 is installed in a socket 102 having a body 56. Body 56 has a chamber 58. The top 60 of the socket body 56 is swaged or molded with a flange 62 which is preferably formed into the position shown to capture and fix the locking insert 10 in the chamber 58 of the body 56. The other opposite end of the body 56 is swaged over to form a locking flange 64. Flanges 62 and 64 lock the insert 10 to the socket 102. In FIG. 6, integral shank portion 50 of the shackle 104 extends from one side of the socket 102. A flag 118 (partially shown) extends from the other side of the socket 102. The socket 102, flag 118 and shackle 104 are molded one-piece integral thermoplastic.

FIG. 4*c* is a sectional view taken at the base portion of the fingers. The semicircular shape of the channels 41, 43 in the inside of the fingers is depicted. The semicircular channel 43 of the base portion of the fingers has a diameter greater than the channel 41 in the angled or tip portion of the fingers as shown in FIG. 4*d*. In FIG. 4*d*, the tip or angled portion of the fingers 24, 26 are shown in a sectional view which depicts the semicircular channels 41, 41' in the fingers 26, 24 having a smaller diameter than the channels 43, 43' in the base portion.

Figure 7:
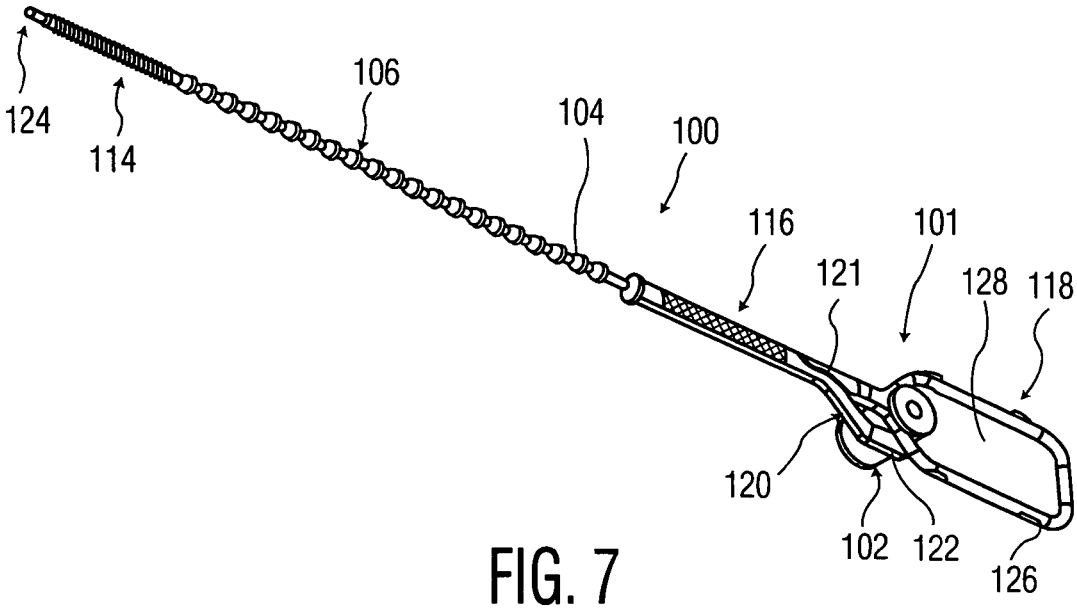
FIG. 7 is an isometric view of a preferred locking seal device comprising a shackle having a free end with an adjacent ridged area on the shackle, and the shackle including annular locking elements-extending in an array toward the free end and a socket for housing the locking insert adjacent an opposite end.
Figure 8:
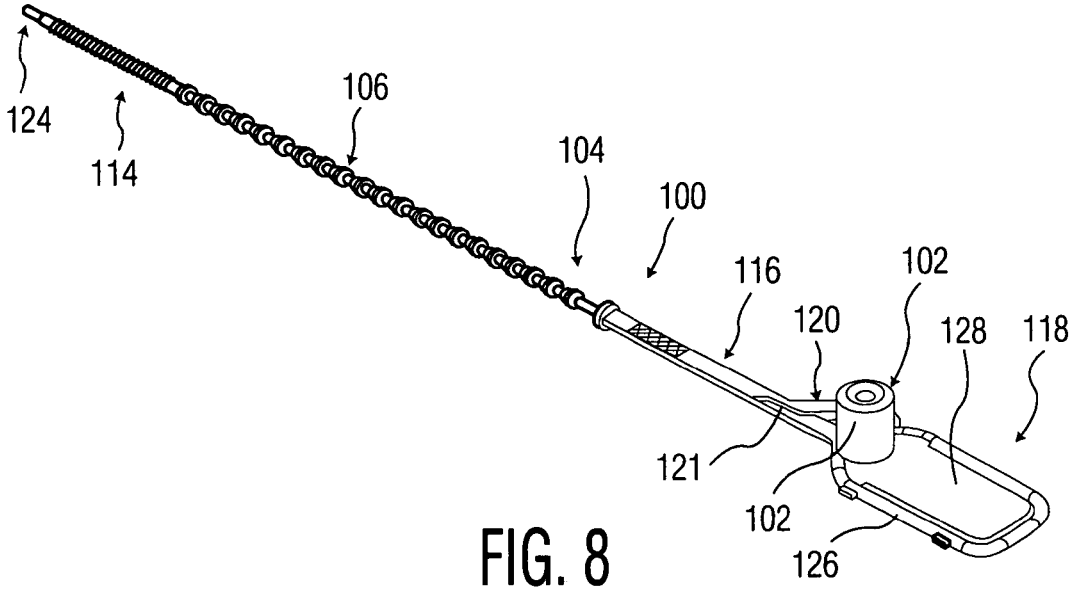
FIG. 8 is a bottom isometric view of the locking seal device shown in FIG. 7.

A preferred embodiment of a locking seal device 100 is shown in FIGS. 7 and 8, and comprises a socket 102 with a locking insert 10 attached. The shackle 104 extends from the socket 102. The shackle 104 has locking elements 106 which are frusto-conical. The locking elements 106 are shown in more detail in FIG. 8*a*. The frusto-conical locking elements 106 have a tapered portion 108 and a rim 110 forming a locking shoulder 112. The free end 124 of the shackle 104 has a gripping ridged portion 114. The locking elements are in a linear array and extend circumferentially about the shackle 104. The shackle is connected to the flag structure 118 and to the socket 102 via a rectangular in section planar shank 116. Shank 116 is positioned between the socket 102 and the locking elements 106. The socket 102 is preferably attached between the planar shank 116 and the flag structure 118 as shown in FIG. 8. The planar shank 116 may be sufficient in area to include lettering for identification as shown in FIGS. 7 and 8.

The flag structure 118 is positioned on the opposite side of the socket 102 from the locking elements 106. The flag structure 118 preferably includes a flag 128 of a relatively thin thermoplastic and is flexible and easily bent manually. A finger grip 126 is of circular cross section to provide enhanced strength and is provided a smooth surface with no protrusions. The finger group 126 is also flexible and can easily be bent manually. The diameter of the finger grip 126 in the embodiment shown in FIGS. 7 and 8 is larger than the thickness of the flag element 128 shown in FIGS. 3 and 6. See the patent '808 mentioned in the introductory portion for more detail on the flag structure 118.

Preferably a pull arm 120 extends at an angle from a planar shank 116 toward the flag structure 118 and terminates with an end piece 122 extending parallel to the planar shank 116. The pull arm 120 provides a way to break the seal when desired. Preferably the pull arm 120 is connected to or adjacent a weakened region 121 of the planar shank 116 to facilitate the breaking and removal of the seal from its locked condition. The pull arm 120 can be twisted or pulled to provide the tensile load and fracture the planar shank of the seal.

Figure 8A:
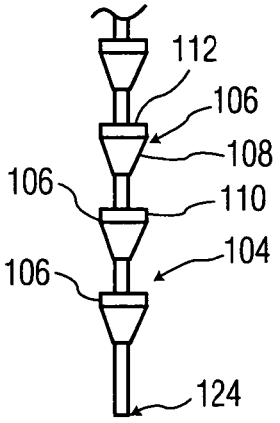
FIG. 8*a* is a detail view of a portion of the shackle shown in FIGS. 7 and 8.

The operation of the locking arrangement without the socket 54 in place is shown in FIGS. 9–12. A detail view of the locking elements of the shackle are shown in FIG. 8*a*. The locking elements 106 are positioned in series about the shackle 104. The locking elements 106 are frusto-conical including a frusto-conical portion 108 and a rim 110 having the greatest diameter of the locking element 106. The rim 110 has a shoulder 112. The shoulder 112 provides a locking surface which engages the tip portions 32 of the fingers 24, 26, 28, 30. The locking elements 106 are preferable rigid and non-flexible.

Figure 14:
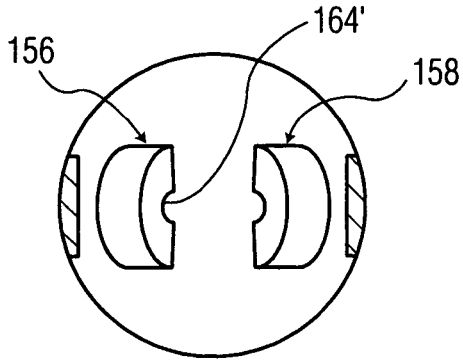
FIG. 14 is a plan view of the locking insert shown in FIG. 13.

The ridged portion 114 between the free end 124 of the shackle 104 and the locking elements 106 of the shackle. 104 is shown in more detail in FIG. 14. The ridges provide a surface which is easily gripped when inserting the shackle into the socket.

Figure 9:
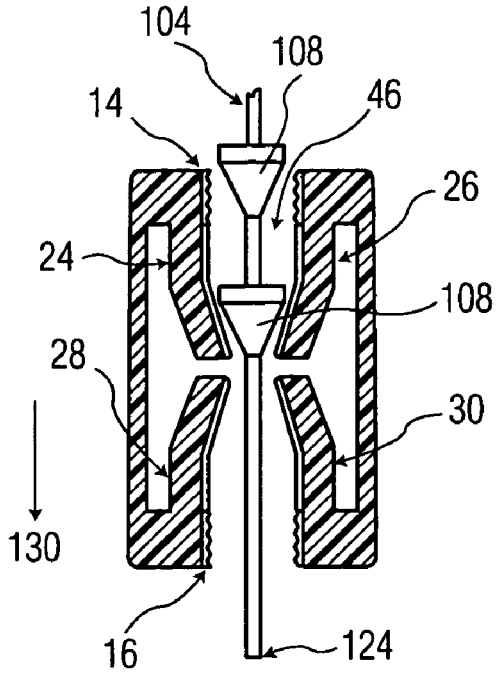
FIG. 9 is a side elevational view in cross section of the locking insert having the free end of the shackle with locking elements inserted through the top opening.
Figure 11:
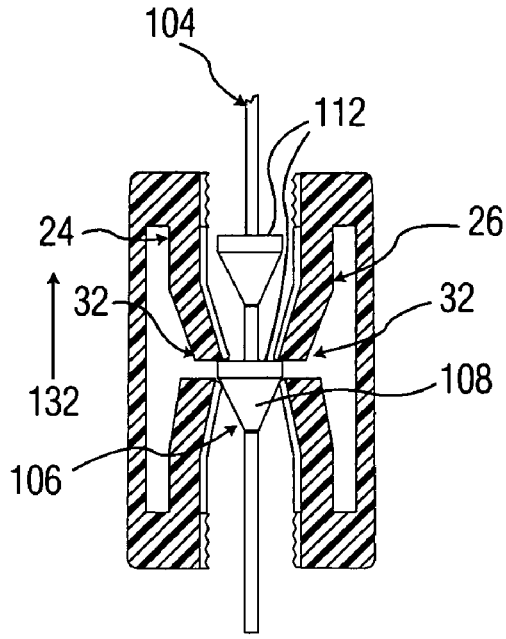
FIG. 11 is a side elevational view in cross section of the locking insert shown in FIGS. 9 and 10 with the locking element in a locked position.

In operation, in FIGS. 9, 10 and 11, the shackle can be inserted either through the opening in the top end 14 or the opening in the bottom end 16 and wrapped around the neck of a sack or bag. In FIG. 9, the free end 124 of the shackle has been inserted into the opening in the top end 14 in insertion direction 130. As shown in FIG. 10, the top fingers 24, 26 are resiliently deflected to allow the locking elements 106 to pass through the passageway 46. The fingers 24, 26 ride up the frusto-conical surfaces of the locking elements 106 and are deflected radially outwardly as the shackle is pulled through the passageway 46.

Further, if the shackle is continued to be pulled through the passageway 46, the bottom set of fingers 24, 26 also ride up the conical shaped locking element and are resiliently deflected radially outwardly. The locking action of the opposing fingers permits insertion of the shackle in direction 130, but hot withdrawal in the opposite direction 132.

If the shackle is pulled in the direction 132 opposite insertion (FIG. 11), the shoulders 112 of a locking element contacts the tip portions 32 of the top fingers 24, 26, and locks the shackle preventing it from being removed from the socket 102. The shackle can still proceed in the insertion direction 130 tightening the loop defined by the shackle 104 and the socket 102. At any point of insertion of the shackle after a locking element has proceeded into the passageway past a first set of fingers, if the shackle is pulled in a direction opposite insertion 132, the tip portions 32 of the fingers will engage a shoulder 112 and lock the shackle to prevent it from being disengaged from the passageway 46 of the locking insert 10, FIG. 11.

Figure 12:
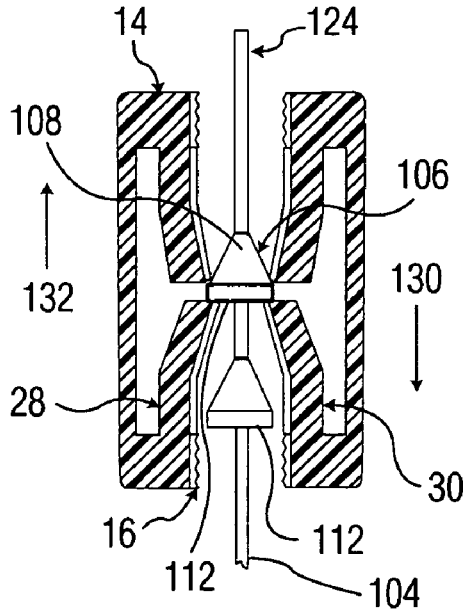
FIG. 12 is a side elevational view in cross section of the locking insert shown in FIG. 11 with the shackle inserted through the bottom opening and the locking element in a locked position.

When the shackle is inserted through the opening in the bottom end 16, as shown in FIG. 12 the insertion direction is 132, and the frusto-conical locking elements 106 and the fingers interact in the same way as described above. However, as shown in FIG. 12, when the shackle is pulled in the direction 130 opposite the insertion is direction the bottom fingers 28, 30 engage the shoulder 112 of the locking element 106 and lock the shackle 104 in place preventing it from being removed.

Figure 13:
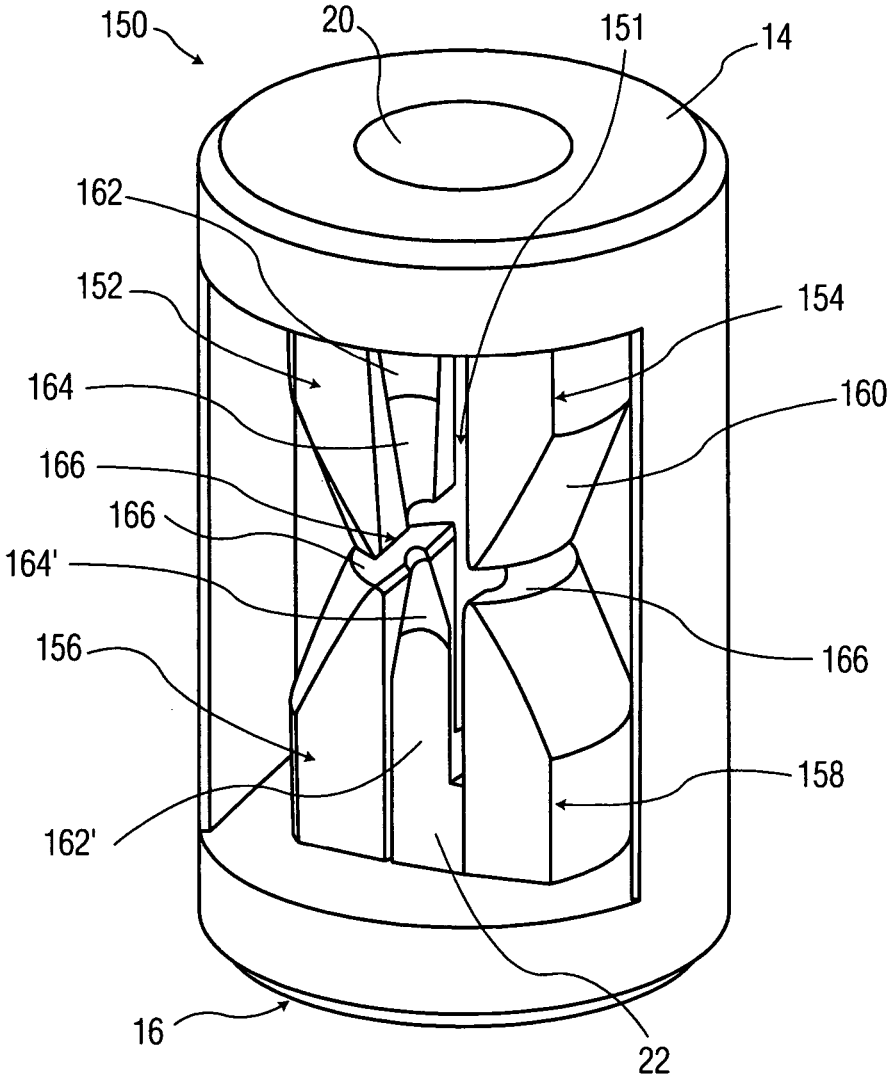
FIG. 13 is a isometric view of another embodiment of the locking insert.
Figure 15:
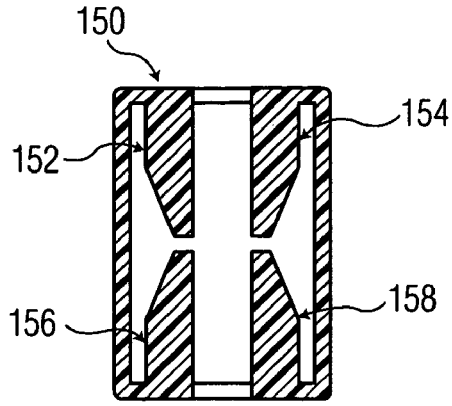
FIG. 15 is a cross sectional view of the locking insert shown in FIG. 13.

Another embodiment of a locking arrangement in the form of a locking insert is shown in FIGS. 13–15. The locking insert 150 is substantially the same as the insert shown in FIG. 1, having a cylindrical shaped body having a top end 14 and a bottom end 16. Upper finger 152, 154 and lower fingers 156, 158 are in opposite, spaced mirror relation. The fingers 152, 154, 156, 158 in the embodiment of the locking insert shown in FIGS. 13 and 15 are linear and do not have the second inwardly extending portion as in the embodiment shown in FIG. 1. The outside surface 160 of representative finger 154 may be inclined as shown in FIG. 13 as in the finger shown in FIG. 1, however, the inside surface of the fingers 152,154, 156, 158 are linear. The fingers 152, 154, 156, 158 are also depicted in the cross sectional view shown in FIG. 15.

As shown in FIG. 13, a concave channel 162 in the inner surface of representative finger 152 has a first diameter and tapers to a smaller diameter channel 164 as the channel nears the tip portion of the finger 152. Similarly, representative bottom finger 156 includes a concave channel 162' in it's inner surface having a first diameter and taper to a smaller diameter channel 164 as the channel nears the tip portion 166 of the finger 156. The fingers operate in essentially the same manner as the fingers in the embodiment shown in FIG. 1. When the frusto-conically shaped locking elements of the shackle pass through the passageway defined by the fingers in an insertion direction, the fingers resiliently expand outwardly, as described in the embodiment shown in FIGS. 9–12, to allow the locking elements 106 to pass through the passageway 151.

The fingers, free end of the shackle can be inserted through the top end 14 20 opening 20 or the bottom end 16 opening 22. Either direction of shackle insertion results in the fingers riding up the frusto-conical surfaces of the locking elements 106 and being deflected radially outwardly as the shackle is pulled through the passageway 151. If the shackle is pulled in a direction opposite insertion, the shoulders 112 of a locking element contact the tip portions 166 of either the top fingers 152, 154, or the bottom fingers 156, 158 depending on the insertion direction, and lock the shackle preventing it from being removed from the insert 150.

A sectional view of the insert shown in FIG. 13 is shown in FIG. 14. The ends of the bottom fingers 156, 158 are shown with the longitudinally extending concave channels 164'.

Figure 16:
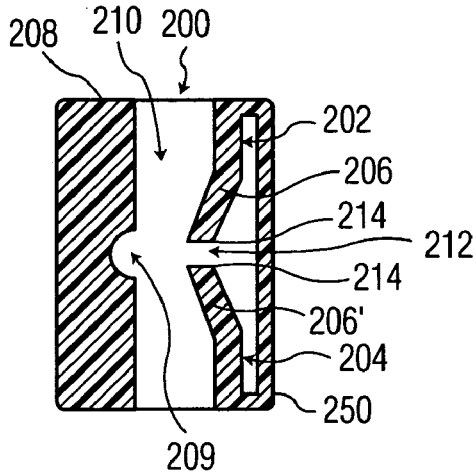
FIG. 16 is a cross sectional view of another embodiment of the locking insert.
Figure 17:
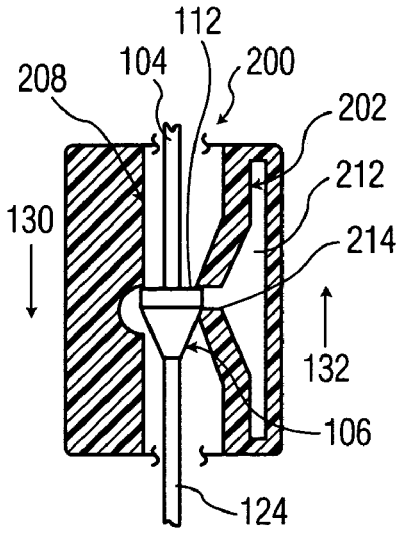
FIG. 17 is a cross sectional view of the insert shown in FIG. 16 having a locking element in a locked position.

Another embodiment of the present invention is shown in FIGS. 16 and 17. A locking arrangement includes a locking insert 200 shown in cross section in FIGS. 16 and 17 which depicts one set of upper and lower fingers 202, 204 in opposing spaced mirror relation. The upper finger 202 has an angled portion 206, and the lower finger 204 also includes an angled portion 206'. A wall 208 extends parallel to the fingers such that the upper and lower fingers 202, 204 and the wall 208 define a passageway 210. The wall 208 defines a transverse semicircular recess 209 juxtaposed across the passageway from the finger tips 214. The recess 209 receives and locks part of the locking element 106 and cooperates with the locking abutment of the locking element 106 against the tip portion 214 of the finger 202, as shown for example in FIG. 17. A space 212 is defined by the fingers and a wall 250 opposite the wall 208. The fingers 202, 204 have the space 212 to flex radially outwardly when riding up the frusto-conical surface 108 of the shackle 104 locking elements 106, FIG. 17. The angled portions 206, and 206' of the fingers 202, 204 extend transverse to the longitudinal axis toward each other defining a smaller passageway between the finger tip portions 214. As shown in FIG. 17, the tip portions 214 lockingly engage the shoulder 112 of the locking element 106 on the shackle 104 when the shackle is pulled in an opposite direction to insertion. The shoulder engages the locking recess 209 which is also in locking abutment with the shoulder 112.

Figure 18:
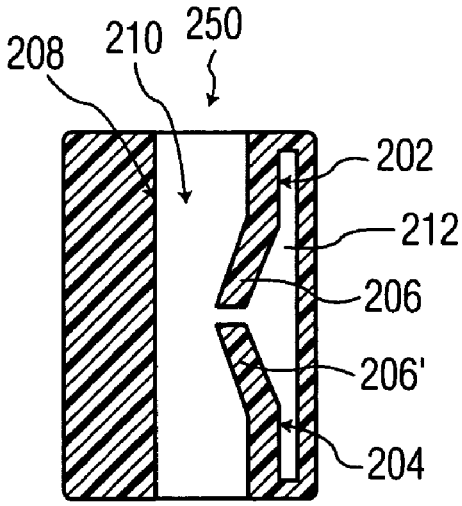
FIG. 18 is a cross sectional view of another embodiment of the locking insert.
Figure 19:
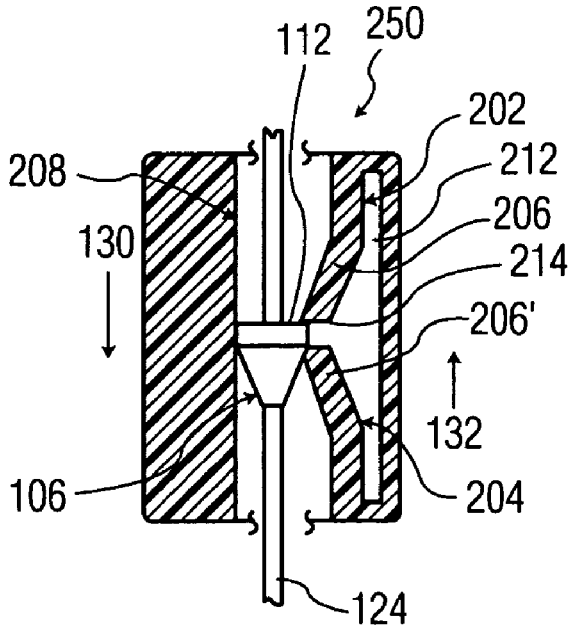
FIG. 19 is a cross sectional view of the insert shown in FIG. 18 having a locking element in a locked position.

Another embodiment of the present invention is shown in FIGS. 18 and 19. A locking insert 250 is shown in cross section which depicts one set of upper and lower fingers 202, 204 in opposing spaced mirror relation, as in the embodiment shown in FIG. 16. However, the wall 208 does not define a transverse semicircular recess but may define a longitudinal recess or channel in which the elements 108 slide. Similarly to the insert shown in FIGS. 16 and 17, the fingers 202, 204 shown in FIG. 19 have the space 212 available to flex radially outwardly when riding up the frusto-conical surface 108 of the shackle 104 locking elements 106. The angled portions 206, and 206' of the fingers 202, 204 extend transverse to the longitudinal axis toward each other defining a smaller passageway between the fingertip portions 214. As shown in FIG. 17, the tip portions 214 lockingly engage the shoulder 112 of the locking element 106 on the shackle 104 when the shackle is pulled in an opposite direction 132 to the insertion direction 130. The side of the locking element 106 abuting the wall 208 is wedged against the wall and works in concert with the locking abutment of the finger tip 214 with the shoulder 112 to lock the shackle in place preventing the shackle from being removed in a direction opposite the insertion direction.

In the various embodiments described herein, the locking arrangement is in the form of a separate insert which is inserted into a chamber in a socket molded one piece, for example, with a shackle.

In the alternative, the locking arrangement body can be formed by a socket member attached to the shackle so that the fingers and socket member are molded one piece thermoplastic with the shackle. Thus, no separate insert is utilized in this embodiment, the fingers of the locking arrangement being formed one piece with the socket body inside the body chamber.

In a further embodiment, the shackle may be a separate unit that is attached to a first socket and locking arrangement. The shackle has an enlarged end at one end to permanently secure it to the first socket wherein the end is too large to pass through the socket. A second socket is molded one piece with the first socket and also has a locking arrangement as described herein. The second socket receives the free end of the secured shackle to form the shackle into a closed loop.

It will occur to one of ordinary skill that modifications may be made to the disclosed embodiments without departing from the scope of the invention as defined in the appended claims. The disclosed preferred embodiment is given by way of illustration and not limitation.

What is claimed is:

1. A bi-directional locking device including a locking arrangement for receiving and locking a shackle thereto, the shackle having at least one locking element, the shackle being insertable into a device chamber for engagement with the locking arrangement, the locking arrangement comprising:

a body defining said chamber therein having a longitudinal axis defining a longitudinal direction, the body having opposing top and bottom ends wherein the top end defines a top opening communicating with the chamber in the longitudinal direction, and the bottom end defines a bottom opening communicating with the chamber in the longitudinal direction; and a plurality of resilient fingers positioned in the chamber, respective ones of the fingers extending in opposing directions toward and substantially aligned with each other in the longitudinal direction, the plurality of fingers each being positioned to allow passage of the at least one locking element of the shackle in first and second opposite insertion longitudinal directions through either the top or the bottom opening, the fingers being arranged so that at least one locking element can pass through the chamber and through both said top and bottom openings in the same insertion direction, at least one of the fingers for locking engaging the at least one locking element to preclude shackle withdrawal from the chamber in a direction opposite to the insertion direction to lock the shackle to the body in the opposite direction.

2. The locking device of claim 1 wherein at least one first finger extends from a region adjacent to the top end and locks with the shackle at least one locking element when the shackle insertion direction is through the top opening to preclude the shackle being withdrawn from the chamber in a direction opposite to the shackle insertion direction, and at least one second finger extends from a region adjacent to the bottom end and locks with the shackle at least one locking element when the shackle insertion direction is through the bottom opening to preclude the shackle being withdrawn form the chamber in a direction opposite to the shackle insertion direction.

3. The locking device of claim 1 wherein the plurality of fingers include a pair of transversely opposing spaced top fingers relative to the longitudinal axis and opposing pair of transversely spaced bottom fingers relative to the longitudinal axis, the top and bottom pairs respectively extending toward one another.

4. The locking device of claim 1 wherein the plurality of fingers include at least one top and at least one bottom finger, the at least one top and bottom fingers being in a mirror image relationship to each other.

5. The locking device of claim 4 wherein the at least one top and bottom fingers each have a channel that extends at an angle inclined toward the longitudinal axis.

6. The locking device of claim 4 wherein the top and bottom fingers include a first portion having a first channel extending in the longitudinal direction connected to the bottom and top ends and a second distal portion having a second channel extending from the first portion first channel at an angle to the first channel.

7. The locking device of claim 6 wherein the angle is acute.

8. The locking device of claim 6 wherein the second distal portion extends toward the longitudinal axis.

9. The locking device of claim 6 wherein the second distal portion of the fingers extend in a direction transverse to the longitudinal axis.

10. The locking device of claim 1 wherein the fingers are integrally molded one piece with and extend from the top and bottom ends.

11. The locking device of claim 1 wherein the device includes a socket with said chamber, the locking arrangement comprising an insert for insertion into the socket chamber.

12. The locking device of claim 3 wherein the plurality of fingers define a passageway adapted to receive the at least one locking element which is annular.

13. The locking device of claim 3 wherein the plurality of fingers define a passageway adapted to receive the at least one locking element which includes a frusto-conical portion and a locking shoulder.

14. The locking device of claim 1 including first and second pairs of spaced mirror image fingers, each pair in mirror image orientation to the other pair, the pairs each defining a portion of a common passageway in the longitudinal direction, wherein the passageway is adapted to receive the at least one locking element which is frusto-conical and includes a rim with a shoulder which abuts the fingers of one of the first and second pairs of spaced mirror image fingers to preclude shackle withdrawal from the chamber in a direction opposite to the insertion direction.

15. The locking device of claim 1 further including a socket having a chamber, wherein the locking arrangement comprises an insert fixedly attached inside the socket chamber.

16. The locking device of claim 15 wherein the shackle has a longitudinal axis, the socket is integral and one piece with the shackle and with a flag and wherein the socket has a longitudinal axis that extends substantially perpendicular to the shackle longitudinal axis.

17. The locking device of claim 15 wherein the body is substantially cylindrical.

18. The locking device of claim 15 wherein the body has a plurality of side walls interconnecting the top and bottom ends, each side wall being spaced from the next adjacent side wall and defining the body chamber.

19. The locking device of claim 2 wherein a passageway is defined by the at least one first and second fingers and an inner side wall in transverse spaced relation relative to the longitudinal axis, and the locking element lockingly abuts the inner side wall when a finger locks to the locking element shoulder.

20. The locking device of claim 19 wherein the inner side wall includes a recess adapted and positioned for lockingly engaging the locking element when at least one of the fingers lock with the locking element shoulder.

21. A bi-directional lockable sealing device comprising:

a socket defining a first chamber therein, a shackle having an at least one locking element, the shackle being fixed at one end to the socket and having a free end opposite the one end;

a locking insert secured to the socket in the first chamber, the locking insert including a body having a second chamber therein defining a longitudinal axis which defines a longitudinal direction, the locking insert including opposing top and bottom ends wherein the top end defines a top opening communicating with the second chamber, and the bottom end defines a bottom opening communicating with the second chamber; and a plurality of resilient fingers positioned in the second chamber, at least one first finger of the plurality extending in a direction away from the top end, at least one second finger of the plurality extending in a direction away from the bottom end toward and aligned with the first finger and extending in an opposite direction as the one first finger, the fingers defining a passageway in the second chamber arranged to allow passage of the at least one locking element as the free end of the shackle is pulled through the passageway in an insertion direction through either the top or the bottom opening such that the fingers are engaged with the at least one locking element, and wherein one of at least one first and second fingers is arranged to abut and lock to at least one locking element of the shackle to preclude shackle movement is in a direction opposite to the insertion direction.

22. The sealing device of claim 21 wherein at least one finger extending from the top end locks with the at least one shackle locking element when the shackle insertion direction is through the top opening and the at least one finger extending from the bottom end locks with the shackle at least one locking element when the shackle insertion direction is through the bottom opening.

23. The sealing device of claim 21 further comprising a flag attached to the socket.

24. The sealing device of claim 21 further including a shank connected to and between the socket and the shackle.

25. A bi-directional lockable sealing device, comprising:

a socket defining a chamber therein having a longitudinal axis defining a longitudinal direction, the socket including opposing top and bottom ends wherein the top end defines a top opening communicating with the chamber, and the bottom end defines a bottom opening communicating with the chamber;

a shackle having at least one locking element, the shackle having a free end; and a plurality of resilient fingers positioned in the socket chamber, at least one first finger of the plurality extending in a direction away from the top end and at least one second finger of the plurality extending in a direction away from the bottom end toward and aligned with the first finger in the longitudinal direction, the fingers and socket defining a passageway in the chamber, the passageway being arranged to allow passage of the at least one locking element as the shackle is pulled through the passageway in an insertion direction through either the top or the bottom opening such that the at least one of the at least one first and second fingers are in engagement with the at least one locking element, and wherein one of the at least one first and second fingers is arranged to abut and lock to the at least one locking element of the shackle to preclude withdrawal of the shackle in a direction opposite to the insertion direction, the fingers being arranged so that at least one locking element can pass through the chamber and through both said top and bottom openings in the same insertion direction.

26. A locking insert for use with a sealing device including a shackle have at least one locking element, the insert comprising a body defining a chamber therein having a longitudinal axis defining a longitudinal direction, the body having opposing top and bottom ends wherein the top end defines a top opening communicating with the chamber in the longitudinal direction, and the bottom end defines a bottom opening communicating with the chamber in the longitudinal direction; and a plurality of resilient fingers positioned in the chamber and extending in a direction away from the body ends in opposite directions toward and aligned with each other in the longitudinal direction, the plurality of fingers being positioned to allow passage of the at least one locking element of the shackle in first and second opposite insertion directions through either the top or the bottom opening, at least one of the fingers for locking engaging the at least one locking element shoulder to preclude shackle movement in a direction opposite to the insertion direction to lock the shackle to the insert in the opposite direction, the fingers being arranged so that at least one locking element can pass through the chamber and through both said top and bottom openings in the same insertion direction.

27. A bi-directional locking device including a locking arrangement for receiving and locking a shackle thereto, the shackle having at least one locking element, the shackle being insertable into a device chamber for engagement with the locking arrangement, the locking arrangement comprising:

a body having said chamber, the chamber defining a longitudinal axis which defines a longitudinal direction, the body having opposing top and bottom ends wherein the top end defines a top opening communicating with the chamber in the longitudinal direction, and the bottom end defines a bottom opening communicating with the chamber in the longitudinal direction; and a plurality of resilient fingers positioned in the chamber and extending toward each other in the longitudinal direction, the plurality of fingers being positioned to allow passage of the at least one locking element of the shackle in first and second opposite insertion longitudinal directions through either the top or the bottom opening, at least one of the fingers for locking engaging the at least one locking element to preclude shackle movement in an opposite direction to the insertion direction to lock the shackle to the body in the opposite direction;

the plurality of fingers including at least one top and at least one bottom finger, the at least one top and bottom fingers being in mirror image relationship to each other, the fingers being arranged so that at least one locking element can pass through the chamber and through both said top and bottom openings in the same insertion direction.

28. A bi-directional locking device including a locking arrangement for receiving and locking a shackle thereto, the shackle having at least one locking element, the shackle being insertable into a device chamber for engagement with the locking arrangement, the locking arrangement comprising:

a body having said chamber, the chamber defining a longitudinal axis which defines a longitudinal direction, the body having opposing top and bottom ends wherein the top end defines a top opening communicating with the chamber in the longitudinal direction, and the bottom end defines a bottom opening communicating with the chamber in the longitudinal direction; and a plurality of resilient fingers positioned in the chamber and extending toward each other in the longitudinal direction, the plurality of fingers being positioned to allow passage of the at least one locking element of the shackle in first and second opposite insertion longitudinal directions through either the top or the bottom opening, at least one of the fingers for locking engaging the at least one locking element to preclude shackle movement in a direction opposite to the insertion direction to lock the shackle to the body in the opposite direction;

the plurality of fingers including a pair of transversely opposing spaced top fingers relative to the longitudinal axis and opposing pair of transversely spaced bottom fingers, the top and bottom pairs respectively extending toward one another, the fingers being arranged so that at least one locking element can pass through the chamber and through both said top and bottom openings in the same insertion direction.

29. A bi-directional locking device including a locking arrangement for receiving and locking a shackle thereto, the shackle having at least one locking element, the shackle being insertable into a device chamber for engagement with the locking arrangement, the locking arrangement comprising:

a body defining said chamber, the chamber defining a longitudinal axis which defines a longitudinal direction, the body having opposing top and bottom ends wherein the top end defines a top opening communicating with the chamber in the longitudinal direction, and the bottom end defines a bottom opening communicating with the chamber in the longitudinal direction; and a plurality of resilient fingers positioned in the chamber and extending toward each other in the longitudinal direction, the plurality of fingers each being positioned to allow passage of the at least one locking element of the shackle in first and second opposite insertion longitudinal directions through either the top or the bottom opening, at least one of the fingers for locking engaging the at least one locking element to preclude shackle movement in an opposite direction to the insertion direction to lock the shackle to the body in the opposite direction;

the plurality of fingers including at least one top and at least one bottom finger, the at least one top and bottom fingers each having a channel that extends at an angle inclined toward the longitudinal axis.

30. A bi-directional locking device including a locking arrangement for receiving and locking a shackle thereto, the shackle having at least one locking element, the shackle being insertable into a device chamber for engagement with the locking arrangement, the locking arrangement comprising:

a body defining said chamber, the chamber defining a longitudinal axis which defines a longitudinal direction, the body having opposing top and bottom ends where the top end defines a top opening communicating with the chamber in the longitudinal direction, and the bottom end defines a bottom opening communicating with the chamber in the longitudinal direction; and a plurality of resilient fingers positioned in the chamber and extending toward each other in the longitudinal direction, the plurality of fingers being positioned to allow passage of the at least one locking element of the shackle in first and second opposite insertion longitudinal directions through either the top or the bottom opening, at least one of the fingers for locking engaging the at least one locking element to preclude the shackle movement in a direction opposite to the insertion direction to lock the shackle to the body;

at least one first finger extending from the top end to lock with the shackle at least one locking element when the shackle is inserted through the top opening and to preclude the shackle withdrawal from the chamber in a direction opposite to the shackle insertion direction, and at least one second finger extending from the bottom end to lock with the shackle at least one locking element when the shackle insertion direction is through the bottom opening and to preclude the shackle withdrawal from the chamber in a direction opposite to the shackle insertion direction;

a passageway being defined by the at least one first and second fingers and an inner side wall in transverse spaced relation relative to the longitudinal axis, the locking element lockingly abuts the inner side wall when a finger locks to the locking element shoulder.

* * * * *